US005957435A

United States Patent [19]

Bronstad

[11] Patent Number: 5,957,435

[45] **Date of Patent: *Sep. 28, 1999**

[54] ENERGY-ABSORBING GUARDRAIL END TERMINAL AND METHOD

[75] Inventor: Maurice E. Bronstad, San Antonio, Tex.

[73] Assignee: TRN Business Trust, Dallas, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/891,678

[22] Filed: Jul. 11, 1997

[51] Int. Cl.[6] ..... E01F 15/00

[52] U.S. Cl. ..... 256/13.1; 404/6

[58] Field of Search ..... 256/13.1–59; 403/2; 404/6, 9

[56] References Cited

U.S. PATENT DOCUMENTS

| | | | |
|---|---|---|---|
| Re. 29,544 | 2/1978 | Fitch | 256/13.1 |
| D. 243,323 | 2/1977 | Waldsmith | D12/169 |
| 2,536,760 | 1/1951 | Martin et al. | 256/13.1 |
| 3,602,151 | 8/1971 | Walker | 104/256 |
| 3,672,657 | 6/1972 | Young et al. | 267/116 |
| 3,674,115 | 7/1972 | Young et al. | 188/1 B |
| 3,680,662 | 8/1972 | Walker et al. | 188/1 B |
| 3,695,583 | 10/1972 | Walker et al. | 256/1 |
| 3,779,591 | 12/1973 | Rands | 293/89 |
| 3,944,187 | 3/1976 | Walker | 256/13.1 |
| 3,973,596 | 8/1976 | Walker | 138/174 |
| 3,982,734 | 9/1976 | Walker | 256/13.1 |
| 4,008,915 | 2/1977 | Walker | 293/60 |
| 4,071,599 | 1/1978 | Walker | 264/311 |
| 4,072,334 | 2/1978 | Seegmiller et al. | 293/71 R |
| 4,073,482 | 2/1978 | Seegmiller et al. | 167/129 |
| 4,097,572 | 6/1978 | Walker | 264/310 |

(List continued on next page.)

FOREIGN PATENT DOCUMENTS

| | | | |
|---|---|---|---|
| 0738802 | 10/1996 | European Pat. Off. . | |
| 1296662 | 6/1969 | Germany | 256/13.1 |
| 3809470 | 10/1989 | Germany . | |

OTHER PUBLICATIONS

PCT Search Report for PCT/US/14367 (091078.0733), Mar. 11, 1998.

PCT Search Report for PCT/US/14491 (091078.0734), Mar. 11, 1998.

America's Most Affordable Crash Cushion Terminal—CAT, Form 039302 (No Date).

Ahead of Its Time . . . Again, one page brochure, Syro, Inc. (No Date).

MPS–350 III (TMA Per NCHRP Report—Level 3), one page brochure, Syro, Inc., Feb. 1997.

(List continued on next page.)

*Primary Examiner*—Harry C. Kim

*Attorney, Agent, or Firm*—Baker & Botts, L.L.P.

[57] ABSTRACT

An energy-absorbing guardrail terminal has a plurality of beams, extending substantially parallel to one another, and having at least one overlapping end; a plurality of break-away support posts coupled to and supporting the plurality of beams; a plurality of fasteners for coupling the plurality of beams to one or more of the plurality of break-away posts; and an arrangement for creating a substantially square wave of energy absorption during telescoping of the plurality of the plurality of beams during a forceful impact of a vehicle on the energy absorbing-guardrail terminal. The substantially square wave of energy absorption during telescoping may be created by a plurality of openings formed on the plurality of beams that are operable to encounter a plurality of fasteners during a forceful impact by a vehicle on the energy absorbing guardrail terminal. A method of manufacturing an energy-absorbing guardrail terminal is also provided.

14 Claims, 7 Drawing Sheets

U.S. PATENT DOCUMENTS

| | | | |
|---|---|---|---|
| 4,274,665 | 6/1981 | Marsh, Jr. | 285/177 |
| 4,289,419 | 9/1981 | Young et al. | 404/6 |
| 4,330,106 | 5/1982 | Chisholm | 256/13.1 |
| 4,352,484 | 10/1982 | Gertz et al. | 256/13.1 |
| 4,452,431 | 6/1984 | Stephens et al. | 256/13.1 |
| 4,498,803 | 2/1985 | Quittner | 404/6 |
| 4,500,225 | 2/1985 | Quittner | 404/6 |
| 4,557,466 | 12/1985 | Zucker | 256/13.1 |
| 4,624,601 | 11/1986 | Quittner | 404/12 |
| 4,635,981 | 1/1987 | Friton | 293/1 |
| 4,655,434 | 4/1987 | Bronstad | 256/13.1 |
| 4,666,130 | 5/1987 | Denman et al. | 256/13.1 |
| 4,674,911 | 6/1987 | Gertz | 404/6 |
| 4,681,302 | 7/1987 | Thompson | 256/13.1 |
| 4,688,766 | 8/1987 | Zucker | 256/13.1 |
| 4,711,481 | 12/1987 | Krage et al. | 293/133 |
| 4,784,515 | 11/1988 | Krage et al. | 404/6 |
| 4,838,523 | 6/1989 | Humble et al. | 256/13.1 |
| 4,844,213 | 7/1989 | Travis | 188/377 |
| 4,934,661 | 6/1990 | Denman et al. | 256/13.1 |
| 5,009,542 | 4/1991 | Hardin, Jr. et al. | 404/6 |
| 5,022,782 | 6/1991 | Gertz et al. | 400/6 |
| 5,078,366 | 1/1992 | Sicking et al. | 256/13.1 |
| 5,088,874 | 2/1992 | Quittner | 416/460 |
| 5,112,028 | 5/1992 | Laturner | 256/13.1 |
| 5,192,157 | 3/1993 | Laturner | 404/6 |
| 5,199,755 | 4/1993 | Gertz | 293/120 |
| 5,211,503 | 5/1993 | Quittner | 404/6 |
| 5,230,582 | 7/1993 | Schmitt et al. | 404/6 |
| 5,248,129 | 9/1993 | Gertz | 256/13.1 |
| 5,286,137 | 2/1994 | Cicinnati et al. | 256/13.1 X |
| 5,314,261 | 5/1994 | Stephens | 404/6 |
| 5,462,258 | 10/1995 | Gaillard et al. | 256/13.1 |
| 5,660,496 | 8/1997 | Muller et al. | 256/13.1 X |

OTHER PUBLICATIONS

Adiem 350 . . . Now Certified to NCHRP Report 350, Level 3, one page brochure, Syro, Inc., Mar. 1997.

U.S. Patent Application filed Jul. 11, 1997 entitled "Guardrail End Terminal for Side or Front Impact and Method," by Maurice E. Bronstad. (08/891,616).

ENERGY-ABSORBING GUARDRAIL END TERMINAL AND METHOD

TECHNICAL FIELD OF THE INVENTION

The invention relates to guardrail end terminals of the type that may be used along roadsides, and more particularly to an energy-absorbing guardrail end terminal and method.

BACKGROUND OF THE INVENTION

Guardrails are traffic barriers placed along roadsides to screen errant vehicles from hazards behind the barrier. A common guardrail in the U.S. is constructed using a standard steel W-beam mounted on spaced wood or steel posts. Because the W-beam functions primarily in tension when redirecting impacting vehicles, a function of the end is to provide necessary anchorage for the beam to develop necessary tensile forces. In addition, since the guardrail end represents a discontinuity in the barrier system, it is subject to being struck "head-on" by vehicles with small departure angles from the roadway. When struck in this manner, the end might spear the vehicle. Some widely used terminal designs "bury" the W-beam at the end to eliminate spearing, but this design may have shortcomings including causing problems relating to vaulting and rollover due to the vehicle riding up the end, and subsequently becoming airborne.

Another type of highway safety device is the crash cushion device. Highway agencies have been using crash cushion devices at high accident locations for a number of years. These devices absorb the energy of head-on impacts with decelerations that are not life-threatening for design conditions. Because the number of guardrail terminals is quite large, and the impact probability low for most, the states do not have the resources to employ crash cushion devices at most guardrail ends because of their expense.

Development of terminal designs is complicated by the need to minimize end-on resistance for the small car impacts while still providing the necessary strength for full-size car impacts either on the end or downstream of the approach end. Efforts have been made to address this problem. For example, U.S. Pat. No. 4,655,434 to Bronstad, which is incorporated herein by reference for all purposes, discloses an energy-absorbing guardrail terminal having beams with uniformly, vertically-aligned spaced openings to absorb kinetic energy of an impacting vehicle. The resistant forces developed by the '434 guardrail terminal are in the form of impulses as shown in FIG. 3 of the '434 Patent.

SUMMARY OF THE INVENTION

According to an aspect of the present invention, an energy-absorbing guardrail end terminal is provided that addresses many shortcoming of previous end terminals. According to an aspect of the present invention, an energy-absorbing guardrail terminal has a plurality of beams, extending substantially parallel to one another, and having at least one overlapping end; a plurality of break-away support posts coupled to and supporting the plurality of beams; a plurality of fasteners for coupling the plurality of beams to one or more of the plurality of break-away posts; and an arrangement for creating a substantially square wave of energy absorption during telescoping of the plurality of beams during a forceful impact of a vehicle on the energy absorbing-guardrail terminal.

According to another aspect of the present invention, an arrangement for producing a substantially square wave of energy absorption during telescoping of a plurality of beams as part of a guardrail end terminal includes a plurality of openings formed on the plurality of beams that are operable to encounter a plurality of fasteners during a forceful impact by a vehicle on the energy absorbing guardrail terminal.

According to another aspect of the present invention, an energy-absorbing guardrail terminal having an upstream end, the terminal for absorbing energy during an impact by a vehicle includes: a nose section at the upstream end of the terminal; a first force-carrying, energy-absorbing member having a first end and a second end, the first end of the first force-carrying, energy-absorbing member coupled to the nose section for receiving energy during an impact by a vehicle on the terminal; a plurality of fasteners; a second force-carrying, energy-absorbing member having a first end and a second end, the first end of the second force-carrying, energy-absorbing member coupled to a portion of the first force-carrying, energy-absorbing member by the plurality of fasteners; wherein the first force carrying, energy-absorbing member is formed with a plurality of offset openings for registration with the plurality of fasteners and wherein during relative movement of the first force-carrying, energy-absorbing member and the second force-carrying, energy-absorbing member, the plurality of fasteners shred a portion of the first force-carrying, energy-absorbing member with a continuous shredding action.

According to another aspect of the present invention, a method of manufacturing an energy-absorbing guardrail terminal includes forming a plurality of beams with a plurality of openings with an offset pattern, placing the plurality of beams so they extend substantially parallel to one another, and having at least one overlapping end, providing a plurality of break-away support posts coupled to and supporting the plurality of beams, coupling a portion the plurality of beams to one or more of the plurality of break-away posts, and coupling the plurality of beams together with the plurality of fasteners so that when a vehicle forcefully impacts the terminal, the fasteners shred a portion of at least one of the plurality of beams according to the offset pattern.

BRIEF DESCRIPTION OF THE DRAWINGS

A more complete understanding of the invention and its advantages will be apparent from the detailed description taken in conjunction with the accompanying drawings in which.

DETAILED DESCRIPTION OF THE INVENTION

The preferred embodiments of the present invention and its advantages are best understood by referring to FIGS. 1–18 of the drawings, like numerals being used for like and corresponding parts of the various drawings.

Figure 1:
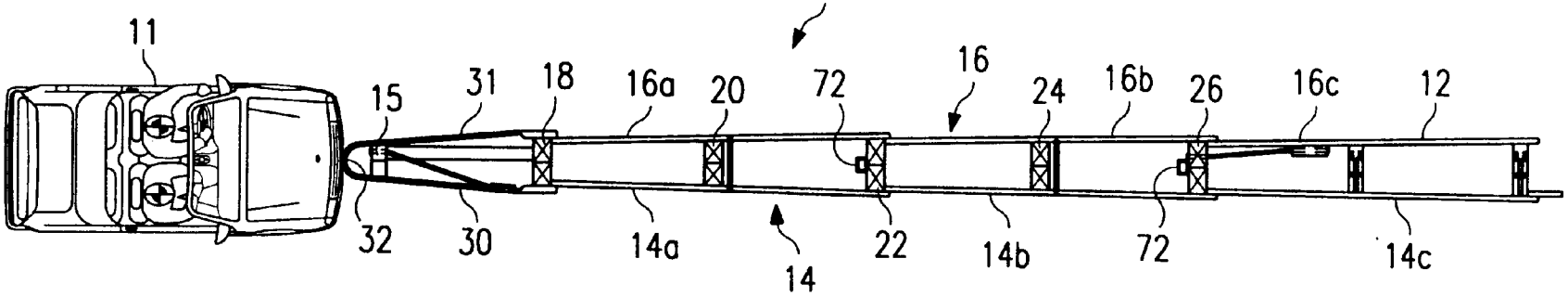
FIG. 1 is a schematic elevational view of an energy-absorbing guardrail terminal according to one embodiment of the present invention being impacted at its upstream or approach end.
Figure 2:
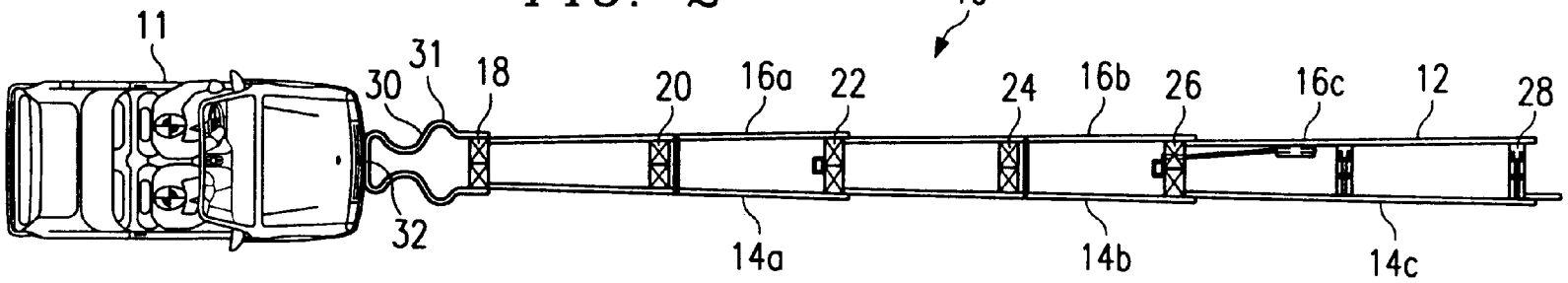
FIG. 2 is a view similar to FIG. 1 wherein the nose section of the terminal collapses on impact releasing the anchor cable as the first post fractures.

Referring now FIGS. 1–2, an energy-absorbing guardrail terminal 10 is shown. Terminal 10 is adapted to be connected to the upstream side of a conventional guardrail terminal 12 having a first set 14 and a second local (i.e., extends only in terminal area) set 16 of longitudinally-extending beams having overlapping ends and supported from a plurality of vertical breakaway posts and blocks 15, 18, 20, 22, 24, and 26, which may be of any suitable number.

A nose section or first section 30 is provided at the upstream end or approach end of terminal 10. The nose section 30 may consist of a wrap-around end 31 connected to posts 15 and 18 as will be more fully described hereinafter.

Each set of beams 14 and 16 includes between posts 18 and 22 a first beam 14*a* and 16*a*, respectively, which overlap the ends of a succeeding beam 14*b* and 16*b*, respectively, which in turn overlaps a beam 14*c* and 16*c*, respectively, which is positioned between posts 26 and posts 28.

The main purpose of terminal 10 is to absorb energy upon impact of a vehicle 11 engaging upstream end 32 of terminal 10. Upon impact of vehicle 11, depending upon the force of the impact, first post 15 will break away and nose section 30 will collapse as shown in FIG. 2. If the force of the impact is sufficient, vehicle 11 will continue and will strike post 18 causing beam members 14*a* and 16*a* to telescope over members 14*b* and 16*b*, respectively, while breaking posts 18 and 20. If the momentum of vehicle 11 is not fully absorbed by the telescoping energy absorbing action of beams 14*a* and 16*a*, beams 14*b* and 16*b* will telescope over beams 14*c* and 16*c*, respectively, and posts 22 and 24 will be broken.

Figure 3:
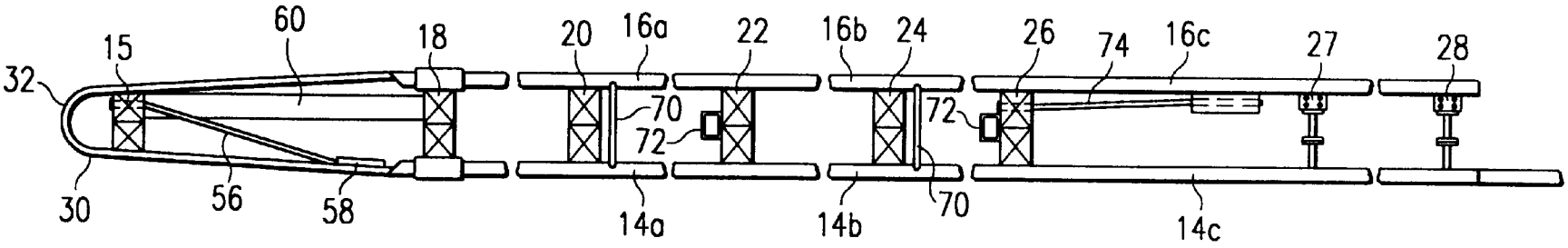
FIG. 3 is a top plan view of an energy-absorbing guardrail terminal according to one embodiment of the present invention.
Figure 4:
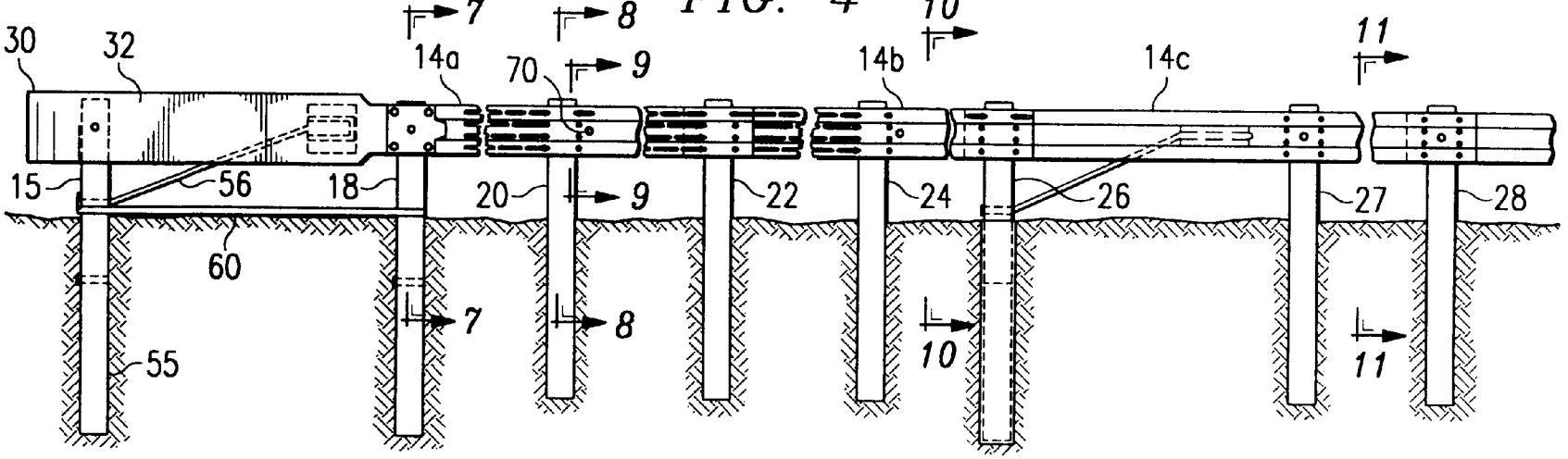
FIG. 4 is an elevational view of the structure of FIG. 3.
Figure 5:
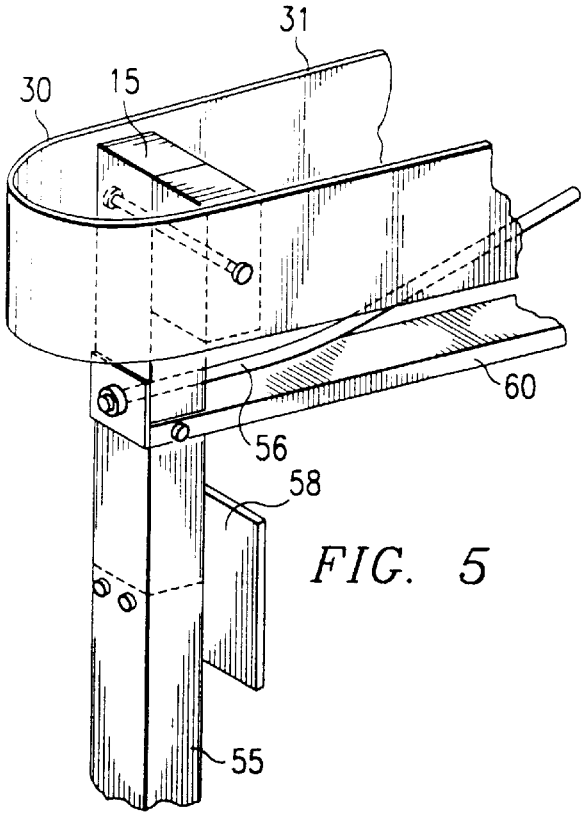
FIG. 5 is an enlarged perspective view of the upstream end of an energy-absorbing guardrail terminal according to an aspect of the present invention.

Referring now to FIGS. 3, 4 and 5, end post 15 is preferably wood mounted in a metal tube 55 having a soil plate 58 for insuring breakage of breakaway post 15 upon impact and for developing cable anchorage forces during downstream impacts. Post 15 is shown with an asymetric arrangment, i.e. with a spacing block on only one side, but it it to be understood that the invention may be used with symetric arrangements, i.e., two blocks against the post to allow the rail to be used on either side. In order to assist terminal 10 in withstanding angular vehicle impacts downstream of end 32, a cable 56 is provided between posts 15 and a fitting 58 on wrap-around end plate 31. In addition, a strut 60 is provided for additional support for the anchor cable forces.

Figure 6:
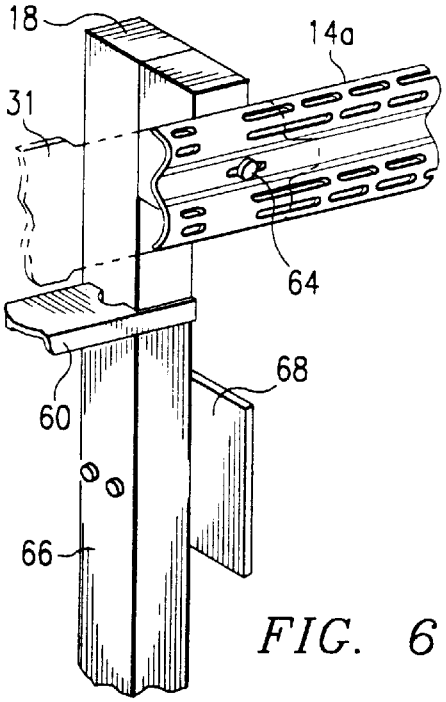
FIG. 6 is a perspective view of the second post from the upstream end of the terminal according to an aspect of the present invention.
Figure 7:
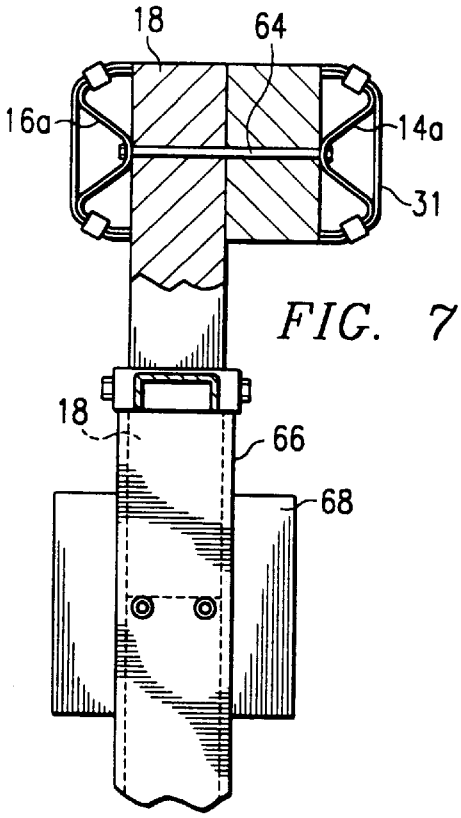
FIG. 7 is a cross-sectional view taken along the line 7—7 of FIG. 4.

Referring to FIGS. 6 and 7, second post 18 supports the upstream ends of beams 14*a* and 16*a* by bolt 64. Second post 18 is also connected to a metal tube 66 with a soil plate 68. Wrap-around end 31 is spliced to beams 14*a* and 16*a* at conventional spliced holes.

Figure 8:
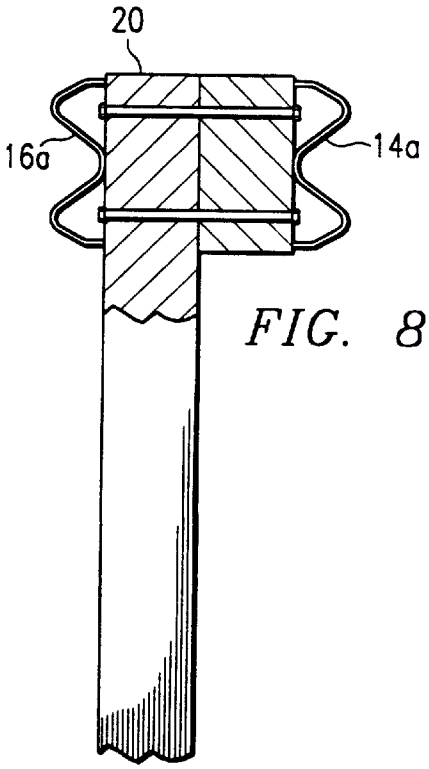
FIG. 8 is a cross-sectional view taken along the line 8—8 of FIG. 4.

FIG. 8 illustrates wood post 20 acting on beams 14*a* and 16*a* intermediate their ends, but without any bolting of beams 14*a* and 16*a* to post 20. Therefore, beams 14*a* and 16*a* are free for telescoping movement without any restraint from post 20. Beams 14*a* and 14*b* are free to slide against post 20. The connection of beams 14*b* and 16*b* to post 24 is similar to that shown in FIG. 8.

Figure 9:
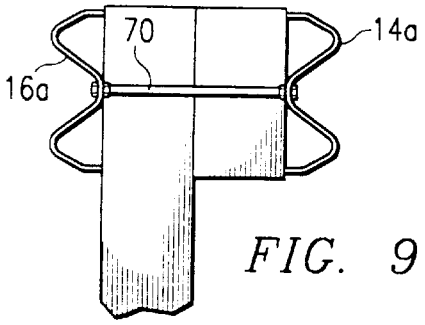
FIG. 9 is a cross-sectional view taken along the line 9—9 of FIG. 4.

Referring now to FIGS. 3 and 9, a spacing rod 70 is illustrated positioned between beams 14*a* and 16*a* for maintaining beams 14*a* and 16*a* in a displaced, parallel relationship by providing nuts on each side of beams 14*a* and 16*a* connected to rod 70. This assists in keeping beams 14*a* and 16*a* parallel as they are telescoped downstream.

Figure 10:
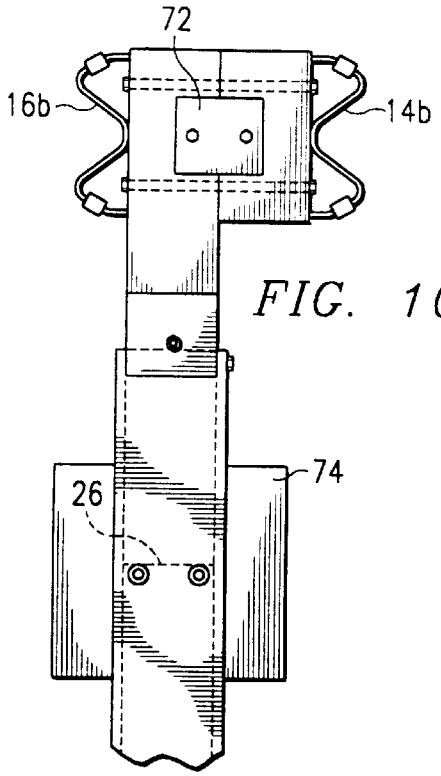
FIG. 10 is a cross-sectional view taken along the line 10—10 of FIG. 4.

Referring now to FIGS. 3, 4 and 10, it is to be noted that a box beam 72 or other construction is mounted downstream of end spacing rod 70 on posts 22 and 26 for bending and releasing rods 70 as beams 14*a* and 16*a* and 14*b* and 16*b* telescope downstream. It is also noted that the end of the second stage section consisting of beams 14*b* and 16*b* is anchored by a cable 74 between the base of post 26, which also includes a metal-to-bottom and soil plate 74 for providing downstream support in the event of an impact for absorbing tension forces in terminal 10.

Figure 11:
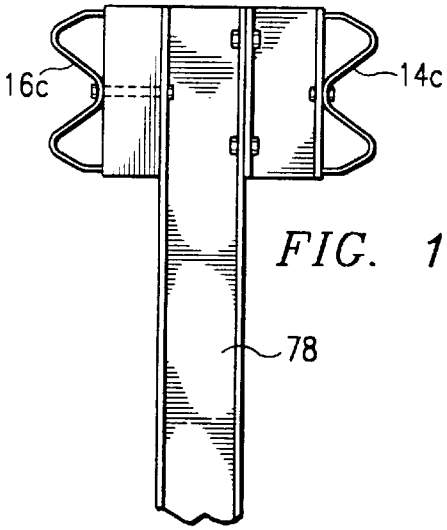
FIG. 11 is a cross-sectional view taken along the line 11—11 of FIG. 4.

Referring now to FIG. 11, a portion of a guardrail 12 is shown having an steel or wood post 78 supporting beams 14*c* and 16*c* by rigid connections to steel or wood post 78.

Figure 13:
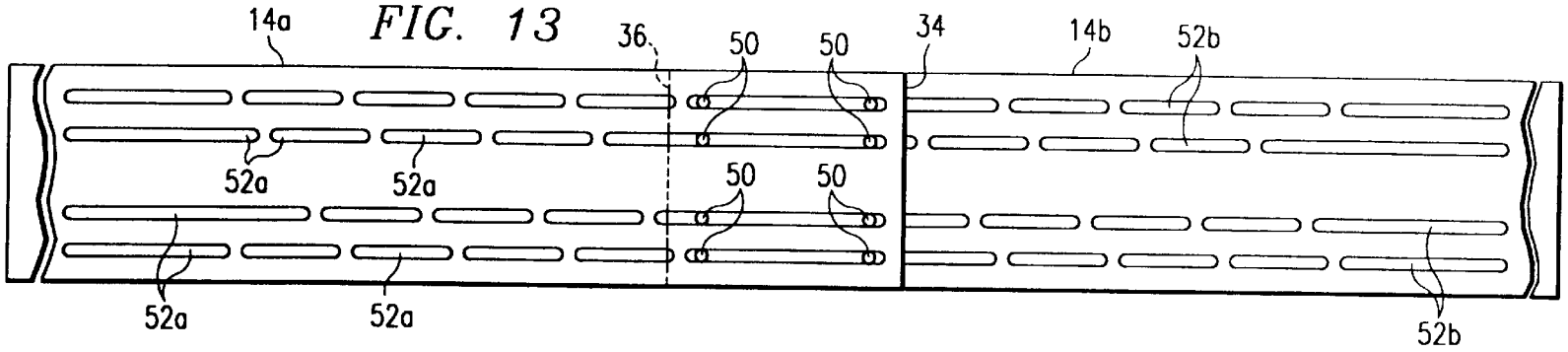
FIG. 13 is an elevational view of the interconnecting of two ends of adjacent beams with spliced bolts in their installed position.

A key aspect of the present invention is the mechanism and method for absorbing energy. The primary energy absorbing mechanism is caused by the shredding of metal strips between a series of openings or slots provided in the beams. Referring now to FIG. 13, the overlapping connection between beams 14*a* and 14*b* is shown. Similar overlapping will occur between beams 14*b* and 14*c*, 16*a* and 16*b*, and 16*b* and 16*c*. As best seen in FIG. 13, end 34 of beam 14*a* will overlap and be on the outside of end 36 of beam 14*b*, which is shown by a hidden line. Beams 14*a* and 14*b* may be of any suitable rigid type beams such as flat rails, but preferably are conventional W-beam beams.

Splice bolts 50, here shown as eight, splice the overlapping end of beam 14*a* to beam 14*b*. The splice fasteners or bolts 50 interconnect only the beams and are not connected to the support posts. As will be more fully described hereinafter, the upstream end of beam 14*b* is secured to a vertical supporting post by one or more fasteners or bolts, but the downstream end of beam 14*a* is not secured by bolts to a supporting post. A plurality of spaced openings 52*a* having a staggered or offset pattern receive splice bolts 50.

Figure 14:
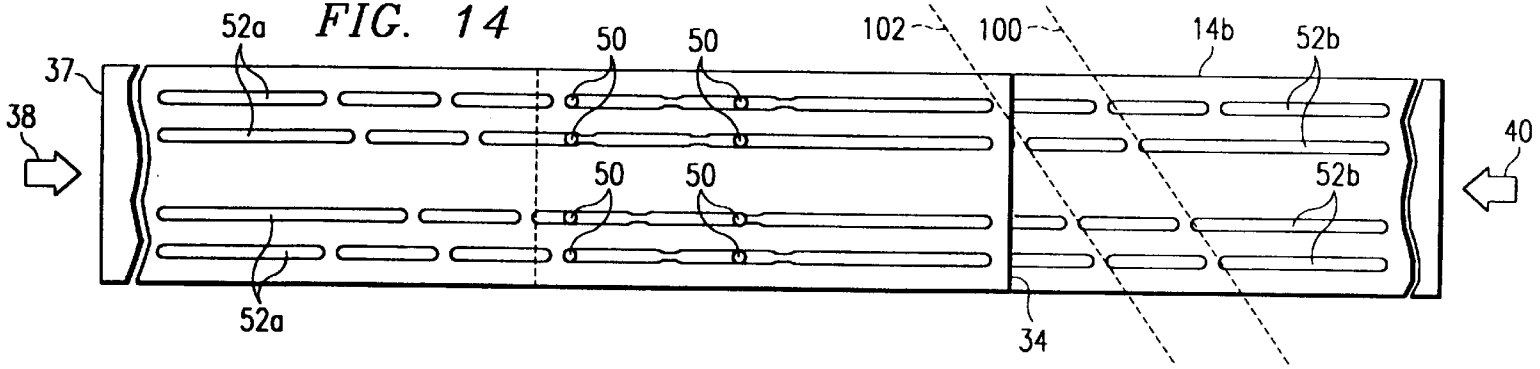
FIG. 14 is an elevational view illustrating the spaced openings and splice fasteners in a pre-impact position.

Therefore, when a vehicle impacts upstream end 37 of beam 14*a* as indicated by arrow 38 in FIG. 14, and with beam 14*b* held stationary to a vertical post and therefore providing a reaction force as indicated by arrow 40, beam 14*a* will move downstream causing splice bolts 50 to shred out the material between spaced openings 52*a*. The shredding out of the metal beam material between spaced openings 52*a* will absorb kinetic energy of the impacting vehicle. Therefore, splice bolts 50 will move through aligned slots 52*a* and shred the material positioned between adjacent horizontally positioned slots 52*a*. According to an important aspect of the present invention, the staggered or offset pattern of slots 52*a* are varied to minimize the force magnitude during the absorption of energy through above shredding. A slot length of the openings is sized to keep the velocity of the telescoping members such that a good tear or shred of a portion of the beam is obtained. In a similar manner, if an impact is forceful enough to cause beams 14 to fully telescope, beams 14*b* will begin telescoping and in the process shredding material between slots 52*b*. Slots 52*b* are preferably analogous to slots 52*a*.

The offset or staggered pattern of slots 52*a* and 52*b* are shown by lines 100 and 102. It is desirable that slots 52*a* extend substantially continuously along the length of beam 14*a*, but must be discontinued before the upstream beam edge encounters the splice bolt heads during collapse which might cause snagging and interrupt the smooth energy absorbing mechanism.

Figure 12:
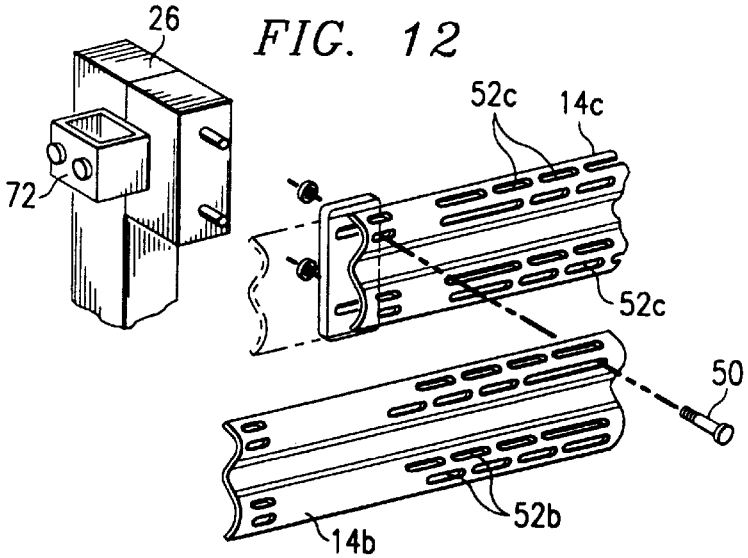
FIG. 12 is an exploded perspective view illustrating the overlapping and splicing of two interconnecting ends of two beams.

The first energy absorbing section consisting of beams 14*a* and 16*a* telescope downstream while the second energy absorbing section consisting of beams 14*b* and 16*b* remain stationary, and beams 14*b* and 16*b* only telescope over beams 14*c* and 16*c*, respectively, after the telescoping of beams 14*a* and 16*a*. Similarly, beams 14*b* and 16*b* will then be free to telescope over the standard guardrail section 12 consisting of beams 14*c* and 16*c*. Any suitable means may be provided to ensure the staging of the collapse of energy absorbing terminal 10. Preferably, the upstream beams are made of a thinner metal than the downstream beams. For example only, beams 14*a* and 16*a* may be of a 12 gauge metal and beams 14*b* and 16*b* may be of a ten gauge metal. FIG. 12 is a perspective exploded view of the connection to post 26 showing the overlap of beams 14*b* and 14*c*.

Figure 15:
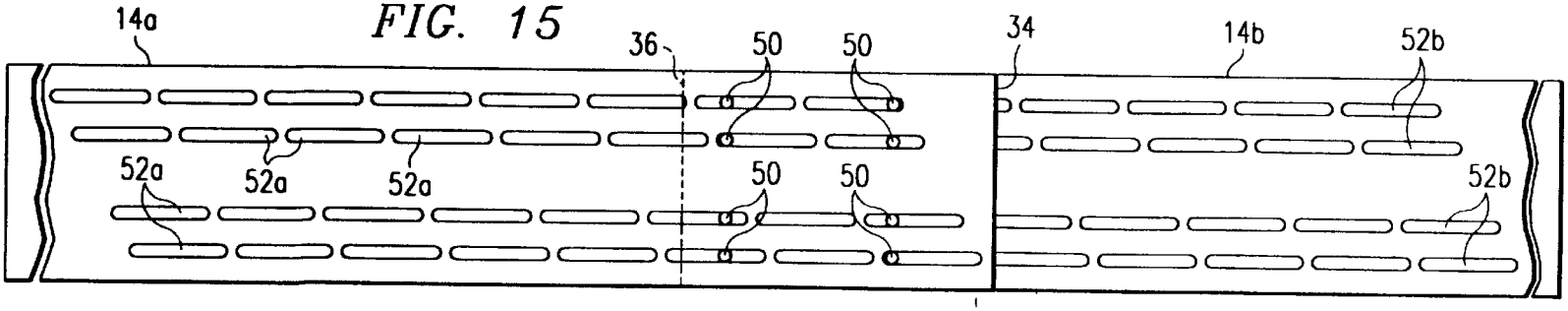
FIG. 15 is an elevational view illustrating the shredding of the material between the spaced openings in the beams to provide the energy absorption or cushion upon impact of the upstream end of the terminal according to an aspect of the present invention.

Referring to FIG. 15, beam 14*a* is shown before any shredding occurs. Additionally, another pattern of slots 52 are shown on beams 14*a* and 14*b*.

Figure 16:
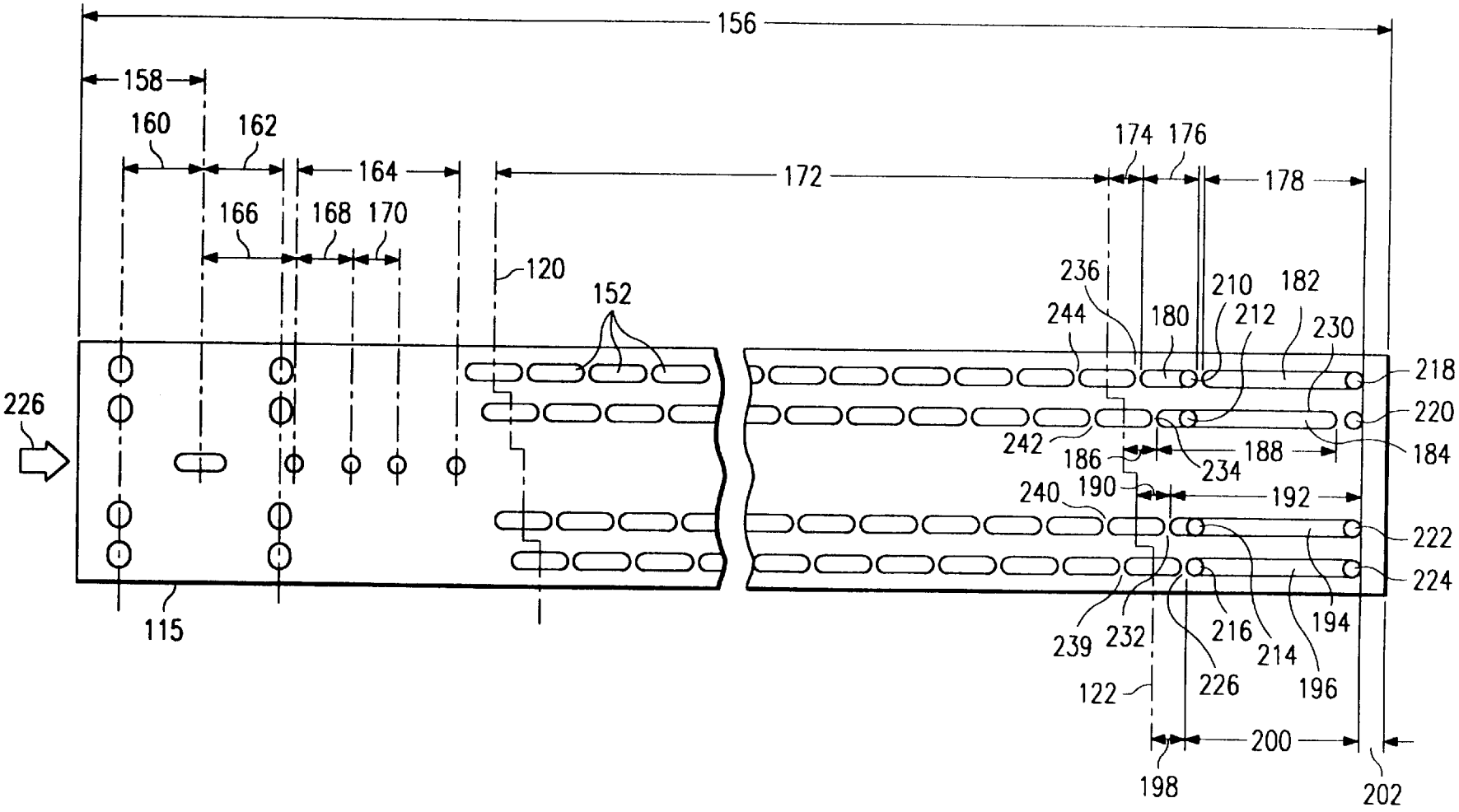
FIG. 16 is an exploded elevational view illustrating an offset pattern of openings on a beam according to one aspect of the present invention.

Referring now to FIG. 16, first local beam 115 is shown. Beam 115 is suitable for use as beam 14*a* in the earlier figures. Beam 115 illustrates one embodiment with specific dimensions. Beam 115 has slots 152, that in this particular embodiment have 38 spaces in each row of material that are shredded as bolts move from the slot to the space between the slots. Table A gives illustrative dimensions for an embodiment in twelve gauge such as may be preferred for beams 14 of FIG. 1 and illustrative dimensions for a beam or ten gauge which may be used, for example, for beams 16 in FIG. 1.

The staggered or offset patterns are shown by lines 120 and 122. Line 120 is shown through center points of a vertical set of openings 152 in beam 115. Similarly, line 122 is shown through center points of a vertical set of openings in beam 115.

TABLE A

| Dimension Reference Numeral | Illustrative Dimensions For 12 Gauge | Illustrative Dimensions For 10 Gauge |
|---|---|---|
| 156 | 13' 6½" | 13' 6½" |
| 158 | 6¼" | 6¼" |
| 160 | 4¼" | 4¼" |
| 162 | 4¼" | 4¼" |
| 164 | 8½" | — |
| 166 | 5" | — |
| 168 | 3" | — |
| 170 | 2½" | — |
| 172 | 10' 5⅞" | 10 5⅞" |
| 174 | 1 13/16" | 1 13/16" |
| 176 | 3¼" | 3¼" |
| 178 | 8¼" | 8¼" |
| 180 | ⅞" × 3" slot | ⅞" × 3" slot |
| 182 | ⅞" × 8¼" slot | ⅞" × 8¼" slot |
| 184 | ⅞" × 9¼" slot | ⅞" × 9¼" slot |
| 186 | 1 13/16" | 1 13/16" |
| 188 | 9¼" | 9¼" |
| 190 | 1 13/16" | 1 13/16" |
| 192 | 9⅞" | 9⅞" |
| 194 | ⅞" × 9⅞" slot | ⅞" × 9⅞" slot |
| 196 | ⅞" × 9 1/16" slot | ⅞" × 9 1/16" slot |
| 198 | 1 13/16" | 1 13/16" |
| 200 | 9 1/16" | 9 1/16" |
| 202 | 1 7/16" | 1 7/16" |

Figure 17:
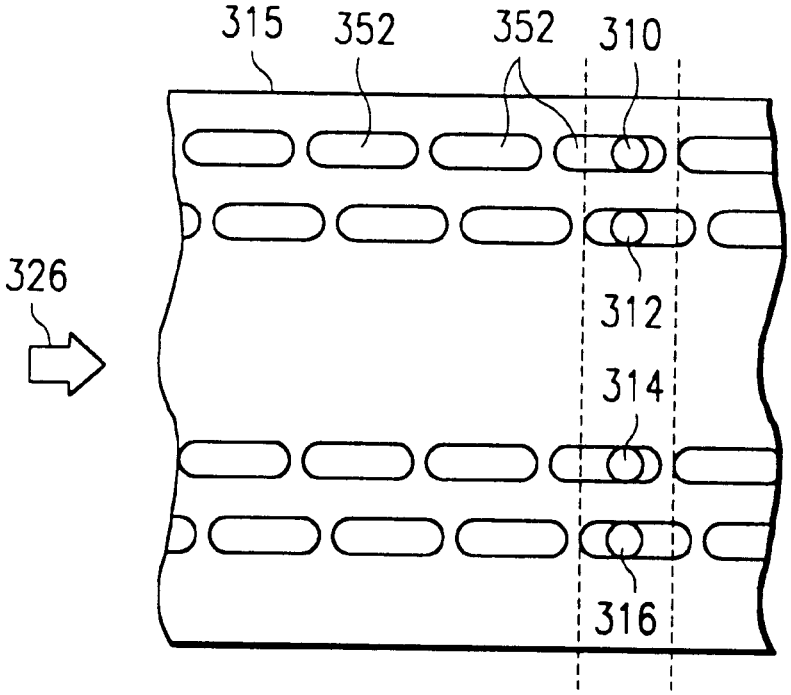
FIG. 17 is an exploded elevational view of a portion of a beam showing an offset pattern according to an aspect of the present invention.

Fasteners or bolts 210–224 are shown positioned in the initial slots for beam 115. It can be seen that if fasteners or bolts 210–224 are held in a fixed position while beam 115 is moved in the direction of arrow 226, fasteners 210–224 will shred metal portions between slots in a continuous pattern, i.e., one bolt is shredding metal at any given time during the shredding process. The pattern illustrated in FIG. 16 is illustrative and other patterns may be used; for example, another pattern is shown in FIG. 17 in which at any given time, two bolts are shredding metal on a beam 315. Slots 352 are arranged with a pattern that such bolt 310 and 314 will shred metal at the same time, and bolts 312 and 316 will shred metal at the same time, as beam 315 moves in the direction of 326 while the bolts remain in their fixed position. The pattern traced preferably minimizes the force eccentricity—keeping it near the centroid each time. Thus, with one pattern, an item can be shred at one extreme end and then immediately at the next opening of the pattern.

Referring again to FIG. 16, an example of the shredding order is presented. In this example, during a forceful impact, bolt 220 would first shred material between its initial position and slot 230. Next, bolt 216 would shred intermediate material 226. Bolt 216 would shred intermediate portion 239. Bolt 214 would then shred material 232. Bolt 212 would shred material 234 and bolt 210 would then shred intermediate portion 236. Next, bolt 214 would shred intermediate portion 240. Then, bolt 212 would shred intermediate portion 242. Then, bolt 210 would shred intermediate portion 244. By shredding only one of the four intermediate portions of the beam that are in line to be contacted by the upstream bolts at any given time, a minimal force is used in the energy-absorbing process caused by shredding. If all bolts encountered material at the same time, it would require a much larger force to initiate the shredding process or action.

When a forceful impact occurs, sufficient kinetic energy is applied to upstream end 32 such that post 15 is broken away and eventually first beams 16*a* and 14*a* are caused to telescope or move relative to second beams 14*b* and 16*b*. Once shredding has been initiated beyond the original notches, the upstream bolts 210, 212, 214 and 216 (FIG. 16) will continue to encounter openings and shred material between them.

The staggered or offset pattern in the beams registers with a plurality of fasteners, e.g. bolts 210, 212, 214, and 216, such that during a forceful impact of the vehicle on the guardrail terminal, sequential shredding of the intermediate material between the plurality of openings occurs. For example, intermediate material 226 would be shredded by bolt 216.

As the shredding of material between openings occurs in response to relative movement, the pattern of shredded material for the embodiment of FIG. 16 will go from the bottom to the top and then return to the bottom and precede towards the top in a repeating pattern. Thus, in a preferred embodiment, the pattern traced will be in the shape of a zig-zag with shredding going from the top to the bottom and then out towards the top and down towards the bottom, etc.

It can be appreciated that according to an aspect of the present invention, the energy-absorbing guardrail terminal has a first force-carrying, energy-absorbing member, such as beam 14*a,* that receives energy from a vehicle during a forceful impact. A plurality of fasteners, such as, bolts 210, 212, 214, and 216, couple the first force-carrying energy-absorbing member to a portion of a second force-carrying, energy-absorbing member, such as beam 146. When energy is applied to the first-carrying, energy-absorbing member causing relative movement between the first and second force-carrying, energy-absorbing members, a nearly continuous shredding action occurs between a portion of the fasteners and a portion of the first force-carrying, energy-absorbing member. The continuous shredding action, which may be created by an offset pattern in a member, develops a substantially square energy absorption characteristic. See, e.g., FIG. 18. The continuous shredding action may be accomplished by a number of means, but the preferred manner, includes using staggered or offset pattern of openings in the first force-carrying, energy-absorbing member.

Figure 18:
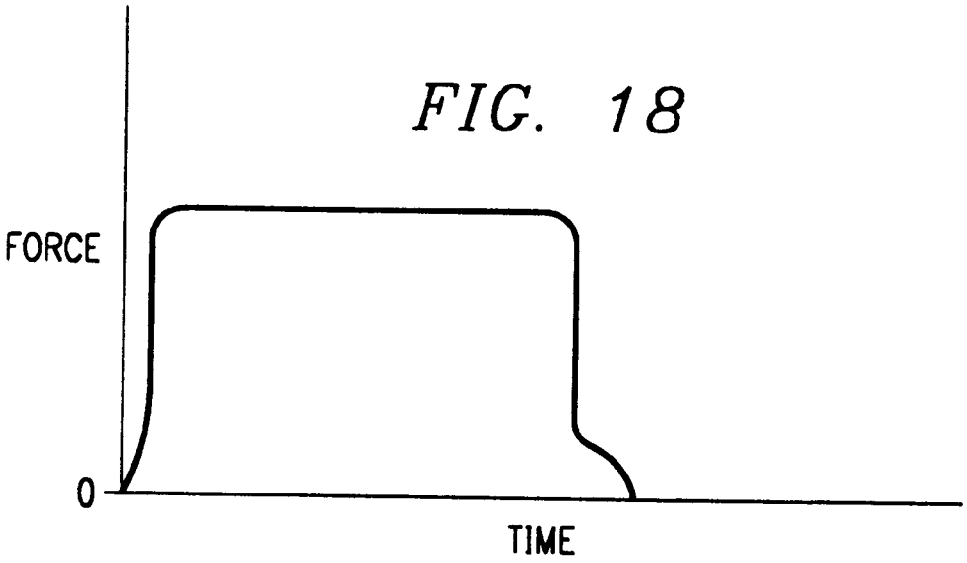
FIG. 18 is a representative graph illustrating the square wave energy-absorbing characteristic according to an aspect of the present invention.

Referring to FIG. 18, an illustrative graph of how the staggered or offset pattern of slots might provide the resistive force over time to vehicle impacting on the upstream end of the energy-absorbing guardrail terminal is shown. The pattern is noted to have a substantially square wave form. This allows for reduced force during the energy absorption. This stands in stark contrast to FIG. 3 of the '434 Patent referenced in the background.

Although the present invention and its advantages have been described in detail, it should be understood that various changes, substitutions, and alterations can be made therein without departing from the spirit and scope of the invention as defined by the appended claims. Among some of the variations that are possible are various lengths of slots and widths and sizes of materials.

What is claimed is:

1. An energy-absorbing guardrail terminal comprising:

a plurality of beams, extending substantially parallel to one another, and having at least one overlapping end;

a plurality of break-away support posts coupled to and supporting the plurality of beams;

a plurality of fasteners for coupling the plurality of beams to one or more of the plurality of break-away posts; and means including the plurality of fasteners for creating a substantially square wave of energy absorption during telescoping of the plurality of beams during a forceful impact of a vehicle on the energy absorbing-guardrail terminal.

2. An energy-absorbing guardrail terminal comprising:

a plurality of beams, extending substantially parallel to one another, and having at least one overlapping end;

a plurality of break-away support posts coupled to and supporting the plurality of beams;

a plurality of fasteners for coupling the plurality of beams to one or more of the plurality of break-away posts; and a plurality of openings formed on the plurality of beams that are operable to encounter the plurality of fasteners during a forceful impact of a vehicle on the energy absorbing guardrail terminal to create a substantially square wave of energy absorption.

3. The energy absorbing guardrail terminal of claim 2, wherein the plurality of fasteners comprises four upstream bolts and wherein the plurality of openings in the beams register with the four upstream bolts such that during the forceful impact of the vehicle at least one of the four upstream bolts shreds a portion of the beam at any given time during energy absorption.

4. The energy absorbing guardrail terminal of claim 2, wherein the plurality of openings in the beams register with the plurality of fasteners such that during the forceful impact of the vehicle on the energy absorbing guardrail terminal, substantially continuous and sequential shredding of intermediate material between the plurality of openings occurs.

5. The energy absorbing guardrail terminal of claim 2, wherein each opening of the plurality of openings in the beams has a center point and wherein each opening of the pattern of openings in the beams is horizontally offset from other openings with respect their center points.

6. The energy absorbing guardrail terminal of claim 2, wherein each opening of the plurality of openings in the beams has a center point and wherein each opening of the pattern of openings in the beams is horizontally offset from other openings by at least three-fourths of an inch with respect their center points.

7. The energy absorbing guardrail terminal of claim 2, wherein the plurality of openings in the beams are arranged in a plurality of vertical sets of openings and wherein a center point of each opening within each vertical set is displaced from center points of the other openings in the vertical set.

8. The energy absorbing guardrail terminal of claim 6, wherein the plurality of vertical sets comprise four openings in the shape of slots.

9. The energy absorbing guardrail terminal of claim 2, wherein the plurality of openings in the beams register with the plurality of fasteners such that during the forceful impact of the vehicle on the energy absorbing guardrail terminal at least one fastener shreds a portion of the beam at any given time during energy absorption and the shredding of the portions of the beam repeatedly traces a zig-zag pattern.

10. The energy absorbing guardrail terminal of claim 2, wherein the plurality of openings in the beams registers with the plurality of fasteners such that during the forceful impact of the vehicle on the energy absorbing guardrail terminal at least one fastener shreds a portion of the beam at any given time during energy absorption and the shredding of the portions of the beam repeatedly traces a pattern going from a bottom portion of the beam to a top portion and back.

11. An energy-absorbing guardrail terminal comprising:

a plurality of beams, extending substantially parallel to one another, and having at least one overlapping end;

a plurality of break-away support posts coupled to and supporting the plurality of beams;

a plurality of fasteners for coupling the plurality of beams to one or more of the plurality of break-away posts; and a pattern of openings in the beams register with the plurality of fasteners such that during a forceful impact of a vehicle on the energy absorbing guardrail terminal at least one fastener shreds a portion of one of the beams at any given time during energy absorption.

12. An energy-absorbing guardrail terminal having an upstream end, the terminal for absorbing energy during an impact by a vehicle, the terminal comprising:

a nose section at the upstream end of the terminal;

a first force-carrying, energy-absorbing member having a first end and a second end, the first end of the first force-carrying, energy-absorbing member coupled to the nose section for receiving energy during the impact by the vehicle on the terminal;

a plurality of fasteners;

a second force-carrying, energy-absorbing member having a first end and a second end, the first end of the second force-carrying, energy-absorbing member coupled to a portion of the first force-carrying, energy-absorbing member by the plurality of fasteners;

wherein the first force carrying, energy-absorbing member is formed with a plurality of offset openings for registration with the plurality of fasteners; and wherein during relative movement of the first force-carrying, energy-absorbing member and the second force-carrying, energy-absorbing member, the plurality of fasteners shred a portion of the first force-carrying, energy-absorbing member with a continuous shredding action.

13. A method of manufacturing an energy-absorbing guardrail terminal comprising:

forming a plurality of beams with a plurality of openings with an offset pattern;

placing the plurality of beams so they extend substantially parallel to one another, and having at least one overlapping end;

providing a plurality of break-away support posts coupled to and supporting the plurality of beams;

coupling a portion the plurality of beams to one or more of the plurality of break-away posts; and coupling the plurality of beams together with a plurality of fasteners so that when a vehicle forcefully impacts the terminal, the fasteners shred a portion of at least one of the plurality of beams according to the offset pattern.

14. The method of claim 13 wherein the step of forming a plurality of beams with a plurality of openings with an offset pattern comprises the steps of forming the beams with each opening of the plurality of openings having a center point and wherein each opening of the plurality of openings in the beams is horizontally offset from other openings with respect their center points.

* * * * *